US005546063A

United States Patent [19]

Hoffman

[11] Patent Number: 5,546,063

[45] Date of Patent: Aug. 13, 1996

[54] MAGNETIC FIELD SOLENOID

[75] Inventor: Jerzy Hoffman, Las Vegas, Nev.

[73] Assignee: United States Defense Research, Inc., Carson City, Nev.

[21] Appl. No.: 261,833

[22] Filed: Jun. 17, 1994

[51] Int. Cl.[6] ..... H01F 7/00; H01F 7/08

[52] U.S. Cl. ..... 335/229; 335/230

[58] Field of Search ..... 335/179, 229–234; 251/129.16

[56] References Cited

U.S. PATENT DOCUMENTS

| | | | |
|---|---|---|---|
| 4,035,789 | 7/1977 | Akita et al. | 340/244 R |
| 4,259,653 | 3/1981 | McGonigal | 335/230 |
| 4,797,645 | 1/1989 | Uetsuhara | 335/230 |
| 5,272,458 | 12/1993 | Hoffman et al. | 335/179 |

*Primary Examiner*—Bot L. Ledynh
*Assistant Examiner*—Raymond M. Barrerg
*Attorney, Agent, or Firm*—Arthur F. Zobal

[57] ABSTRACT

The solenoid includes an electrical coil having a central opening in which is fixedly located a rod formed of a material of the type capable of being magnetized when in a magnetic field. A plunger is supported for movement toward and away from one end of the rod. A permanent magnet is supported by the plunger. In one embodiment the permanent magnet is located such that the plunger and permanent magnet are held next to the coil when the coil is in a deactivated condition. When the coil is activated, the magnetic field produced by the coil repels the permanent magnet and hence the plunger away from the coil. The polarity of the permanent magnet can be reversed in position such that normally the permanent magnet and hence the plunger are normally repelled away from the rod end when the coil is in a deactivated condition. When the coil is activated in a given manner, the magnetic filed of the coil pulls the magnet and hence the plunger next to the coil. In another embodiment two permanent magnets are attached to opposite ends of a plunger of the type unaffected by a magnetic field to form a push-pull type of solenoid.

19 Claims, 9 Drawing Sheets

MAGNETIC FIELD SOLENOID

BACKGROUND OF THE INVENTION

1. Field of the Invention

The invention relates to an electrical solenoid that uses one or more permanent magnets for holding and return purposes.

2. Description of the Prior Art

Many types of solenoids have been in existence for many years. There are some major problems with the known solenoids. These include a limited life of the solenoid due in part to the un-reliability of the return spring, particularly in environments of very low temperatures as found in space and at +126° C. or higher temperatures. For example, at very low temperatures the return springs will fail.

SUMMARY OF THE INVENTION

In one embodiment, the solenoid comprises an electrical coil having a central opening in which is fixedly located a rod formed of a material of the type capable of being magnetized when in a magnetic field. A plunger is supported for movement toward and away from one end of the rod. A permanent magnet is supported by the plunger. In one embodiment the permanent magnet is located such that it is normally attracted to the end of the rod such that the plunger and permanent magnet are held next to the coil when the coil is in a deactivated condition. When the coil is activated, the magnetic field produced by the coil repels the permanent magnet and hence the plunger away from the coil.

In another embodiment, first and second walls formed of a material of the type capable of being magnetized are fixedly located at opposite ends of the coil respectively. The walls have openings in alignment with the central opening of the coil. A plunger formed of material substantially unaffected by a magnetic field is located in the central opening of the coil and in the wall openings for movement in first and second opposite directions. First and second permanent magnets are secured to opposite ends of the plunger. The permanent magnets are located such that the second permanent magnet is attached and held to the second wall when the plunger is in the first position and the first permanent magnet is attracted and held to the first wall when the plunger is in the second position and the coil is deactivated. When the coil is activated in a first manner, the magnetic field produced by the coil repels the second permanent magnet from the second wall to move the plunger to its second position which is held in the second position by the first permanent magnet when the coil is deactivated. When the coil is activated in a second manner the magnetic field produced by coil repels the first permanent magnet from the first wall to move the plunger to its first position which is held in the first position by the second permanent magnet when the coil is deactivated.

DESCRIPTION OF THE PREFERRED EMBODIMENT

Figure 1:
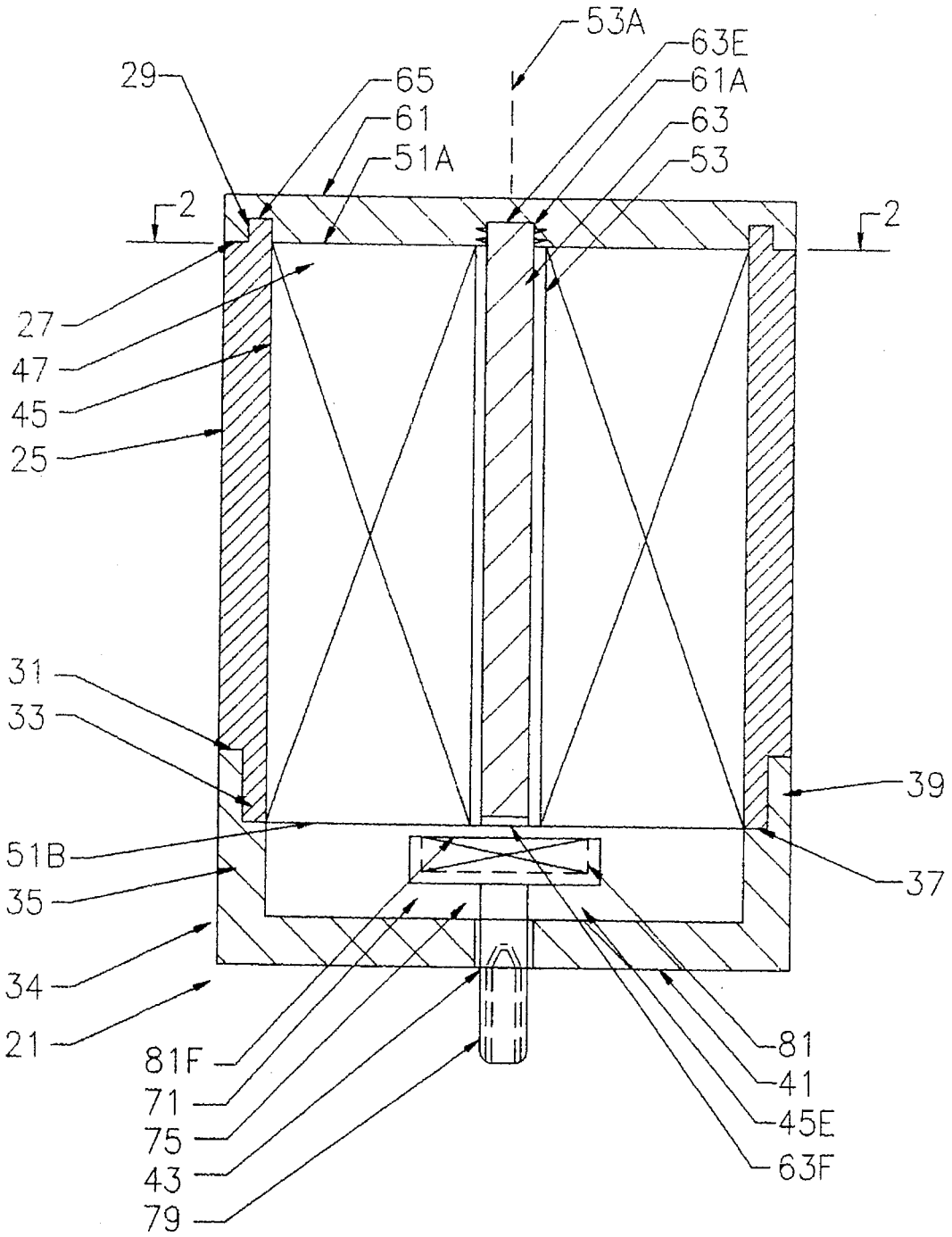
FIG. 1 is a cross-section of one embodiment of the solenoid of the invention.
Figure 2:
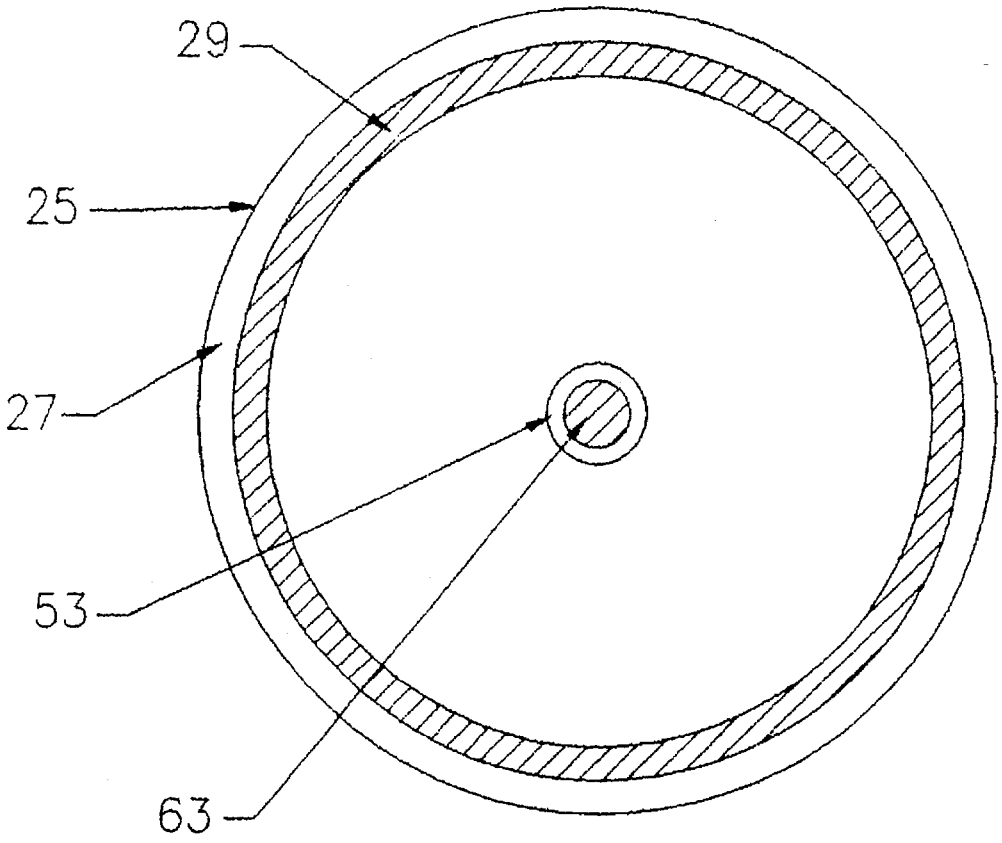
FIG. 2 is a cross-section of FIG. 1 taken through the lines 2—2 thereof.
Figure 3:
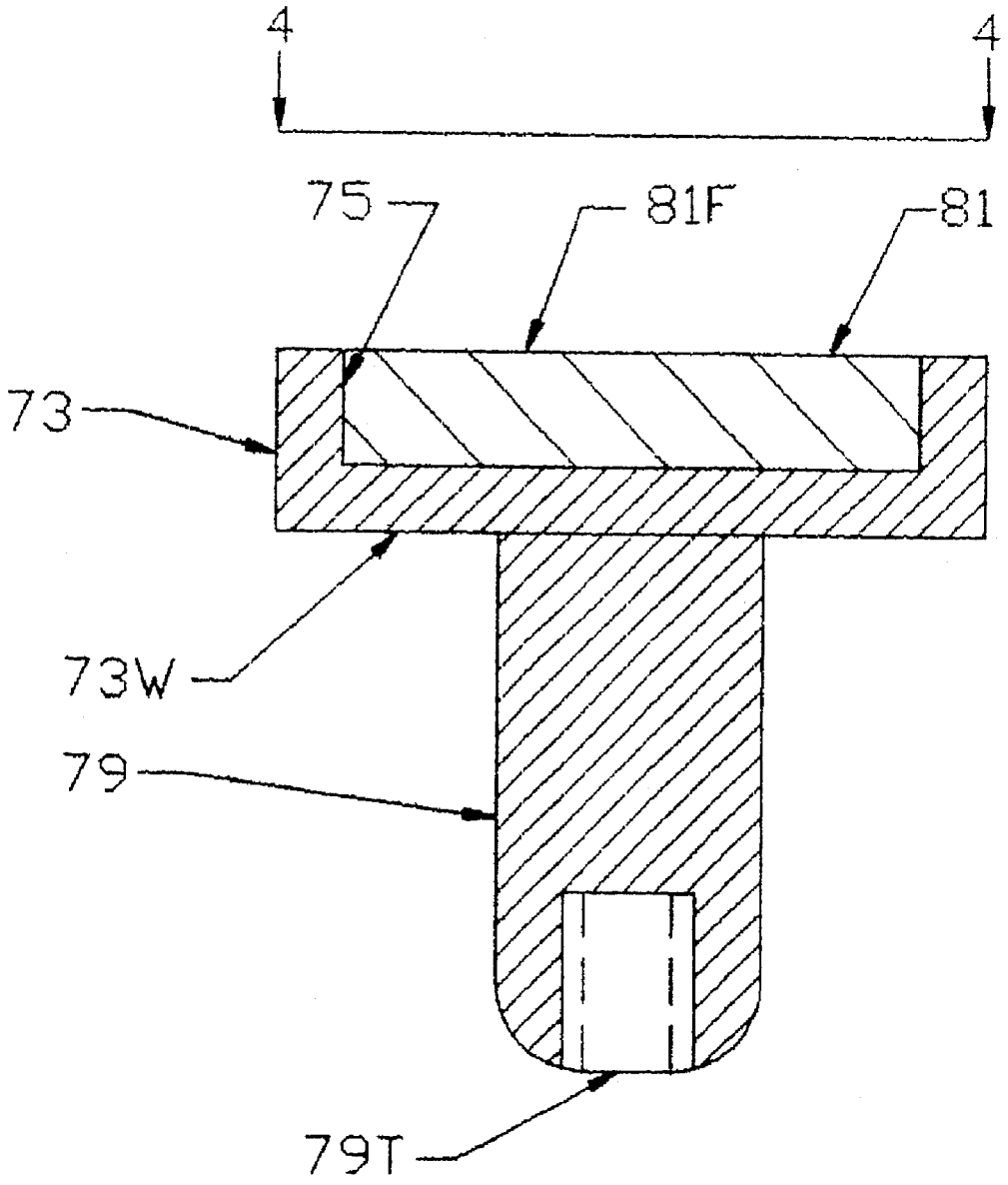
FIG. 3 is a cross-section of the plunger and permanent magnet of the solenoid of FIG. 1.
Figure 4:
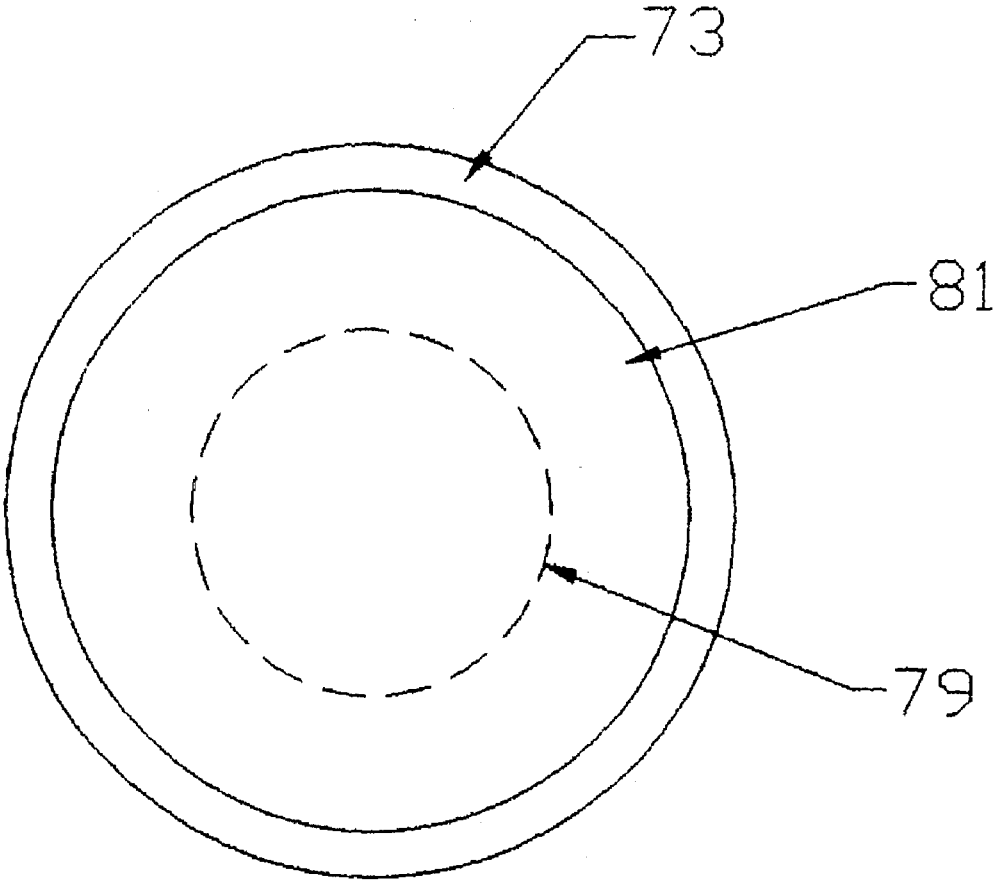
FIG. 4 is a view of FIG. 3, taken from the lines 4—4 thereof.

Referring now to FIGS. 1–5 the solenoid is identified at 21. It comprises a housing 23 formed of a hollow cylindrical wall 25 having a cylindrical shoulder 27 and a cylindrical extension 29 at one end and a cylindrical shoulder 31 with a cylindrical extension 33 at the other end. The wall 25 is formed of a material capable of being magnetized when in a magnetic field. The wall 25 is not a permanent magnet. The wall 25 may be formed of steel such as Corry 99.

An end wall 34 formed of non-magnetic material is provided. The material of the wall 34 is of the type that will not be magnetized when in a magnetic field. The wall 34 may be formed of a suitable stainless steel. The wall 34 comprises a cylindrical wall 35 having a cylindrical shoulder 37 and a cylindrical extension 39 and a wall 41 extending transversely inward with a central opening 43.

The extension 34 of wall 25 is press fitted into the extension 39 of wall 34 to form a cavity 45 having an opening 47.

Located in the cavity 45 on the inside of the wall 25 is an electrical coil 51 having a central opening 53 formed therethrough from end 51A to end 51B. The opening 53 has a central axis 53A. The coil 51 is secured to the inside of wall 41 by a suitable adhesive.

A member 61 is provided comprising a cylindrical disc having a solid cylindrical post 63 attached thereto. Attachment may be by way of a threaded end 63E screwed into a threaded aperture 61A formed in member 61. In the alternative, members 61 and 63 may be formed as a single integral member. The member 61 has a annular slot 65 in which is fixedly fitted the end 29 of the wall 25 such that the disc closes the open end 47 of the cavity 29 with the post fixedly located in the central opening 53 of the coil 51. The end 63F of the post 63 extends to a position near the end 51B of the coil 51. The disc 61 and the post 63 are not permanent magnets but are formed of a material of the type that can be magnetized when in a magnetic filed. The disc 61 and post 63 may be formed of steel such as Corry 99.

Between the end 51B of the coil 51 and the wall 41 is formed an extension 45E of the cavity 45 in which a plunger 71 and a permanent magnet 81 are located. The plunger 71 comprises a disc 73 with a circular cavity 75, and a shaft 79 with a treaded opening 79T for attachment of an extension. The plunger 71, including members 73 and 79 are formed of a non-magnetic material such as a suitable stainless steel substantially unaffected by a magnetic field. The permanent magnet 81 is fixedly secured in the cavity 75. The shaft 79 extends through the opening 43 of the wall 41 and is supported in the opening 43 for movement toward and away from the end 63F of the post 63 to first and second positions. In the first position, the face 81F of the magnet 81 is located next to the end 63F of the post and in the second position, the face 81F of the magnet is located away from the end 63F of the post. In the second position, the wall 73W of the disc 73 engages the inside of the wall 41 to stop movement of the plunger away from the end 63F of the post 63.

The magnet 81 is located such that it will be magnetically attracted to the post 63 in either the first or second position of the plunger. For example, the face 81F of the magnet 81 may have its south side facing the post end 61F. When the plunger is in its first position, and assuming the coil 51 is deactivated, the magnet 81 will be held against the post end 63F by the magnetic field of the magnet 81. When the plunger is located in its second position, and assuming the coil 51 is deactivated, the force of the magnetic field of the magnet 81 is sufficient to pull the magnet 81 next to the post end 63F to move the plunger to its first position.

Figure 5:
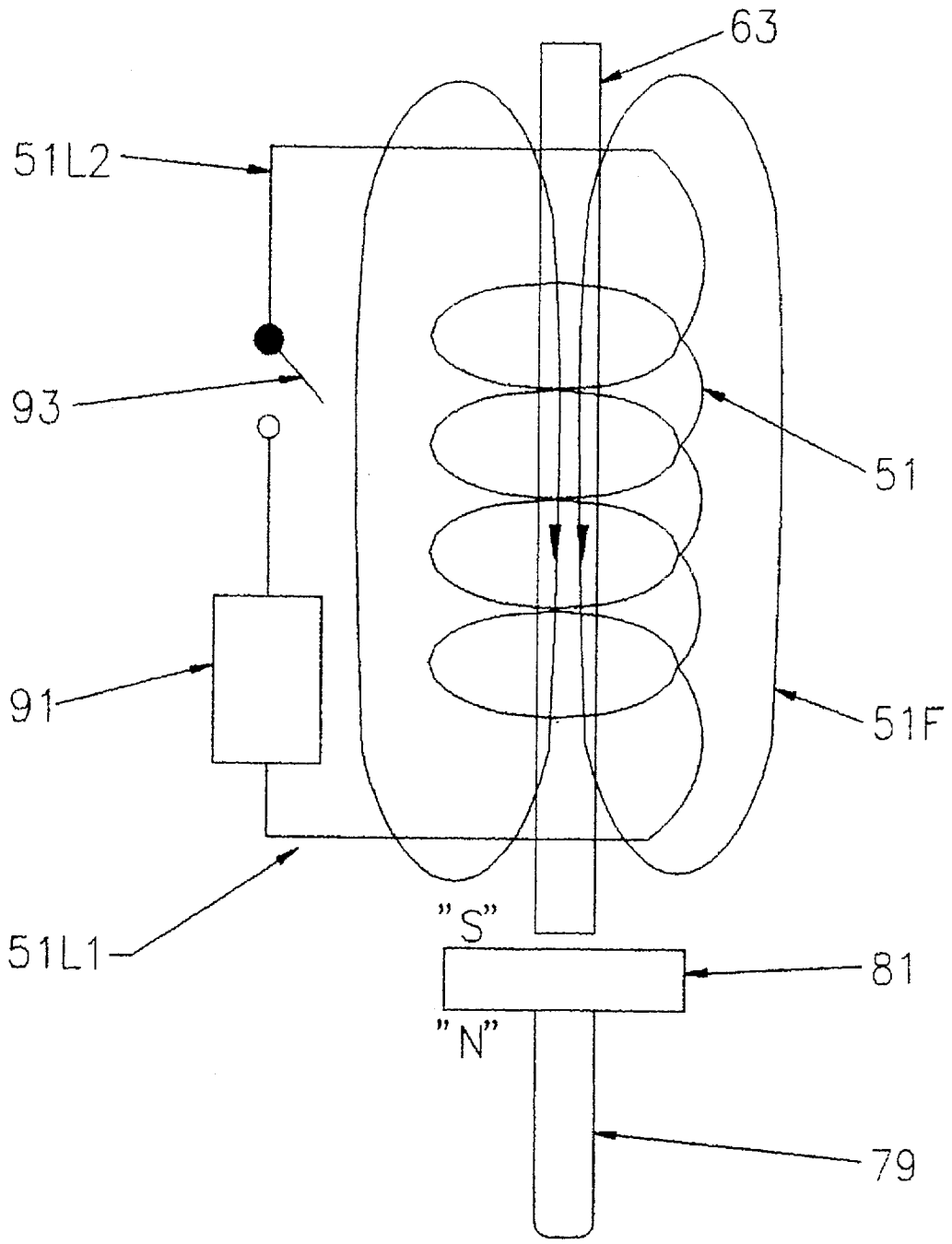
FIG. 5 schematically illustrates the solenoid of FIG. 1.

Referring to FIG. 5, there is shown a source 91 of electrical power, such as a DC voltage source, connected to the leads 51L1 and 51L2 of the coil 51. The lead 51L2 has a switch 93. When the switch 93 is in an open position, the plunger 71 will be located in its first position. When the switch 93 is closed, the coil 51 produces a magnetic field 51F which repels the magnet 81 and hence the plunger 71 away from the post end 63F to the second position of the plunger. The polarity of the source coupled to the leads 51L1 and 51L2 is such as to cause the field 51F to repel the magnet 81. A portion of the field 51F passes through the walls 25 and 61 and rod 63. When the coil 51 is de-activated, the field of the magnet 81 pulls the magnet 81 next to the post end 63F.

Thus as can be understood, the solenoid of FIGS. 1–5 does not require springs and can be easily operated when desired. It may be operated effectively in a very cold environment or a hot environment. It may be used for various control purposes. The switch 93 may be an electronically controlled switch which may be operated remotely if desired.

Figure 6:
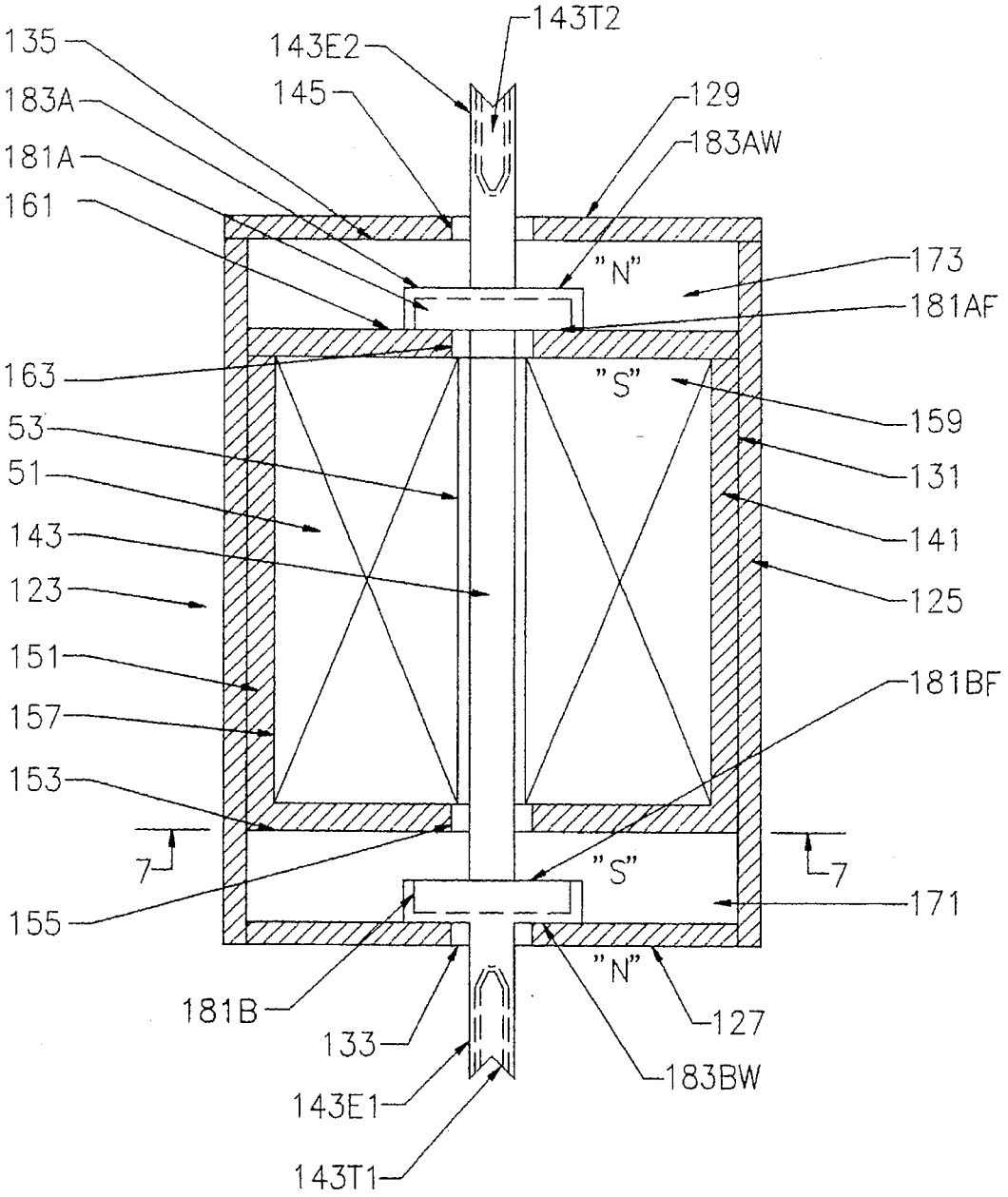
FIG. 6 is a cross-section of another embodiment of the solenoid of the invention.
Figure 7:
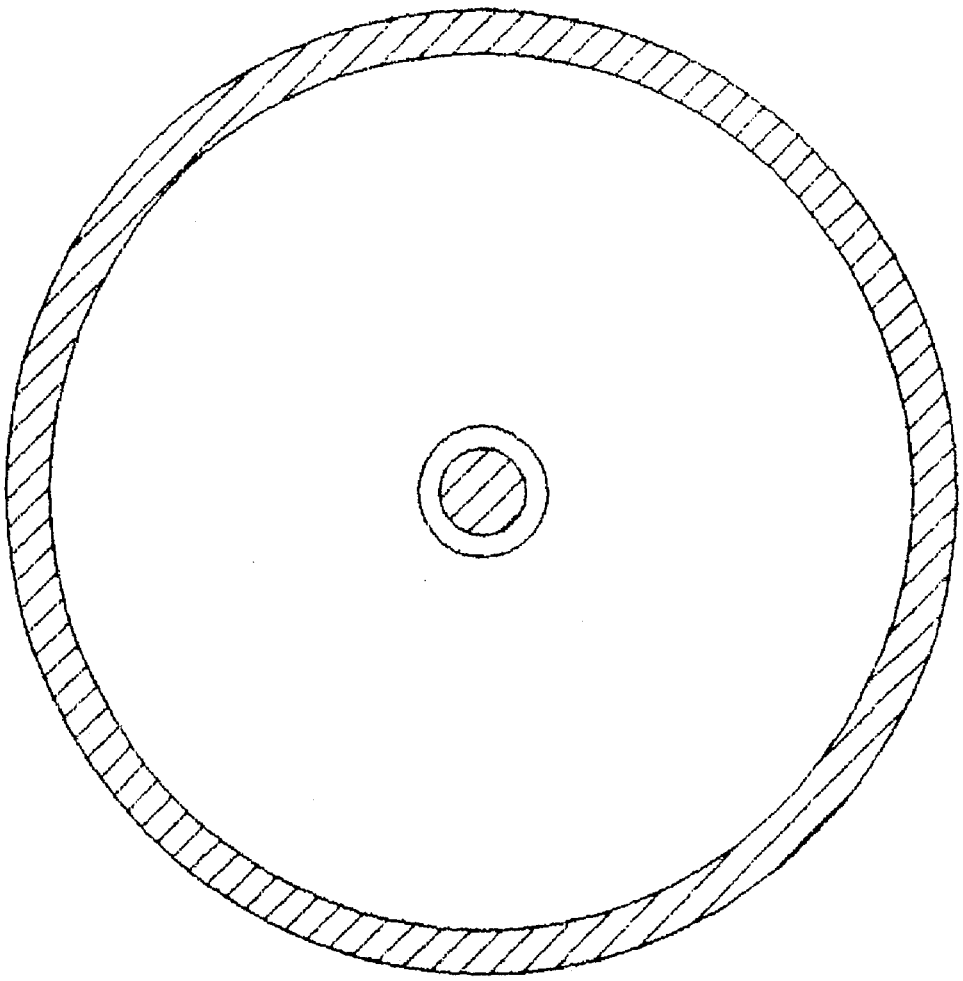
FIG. 7 is a cross-section of FIG. 6 taken along the lines 7—7 thereof.
Figure 8:
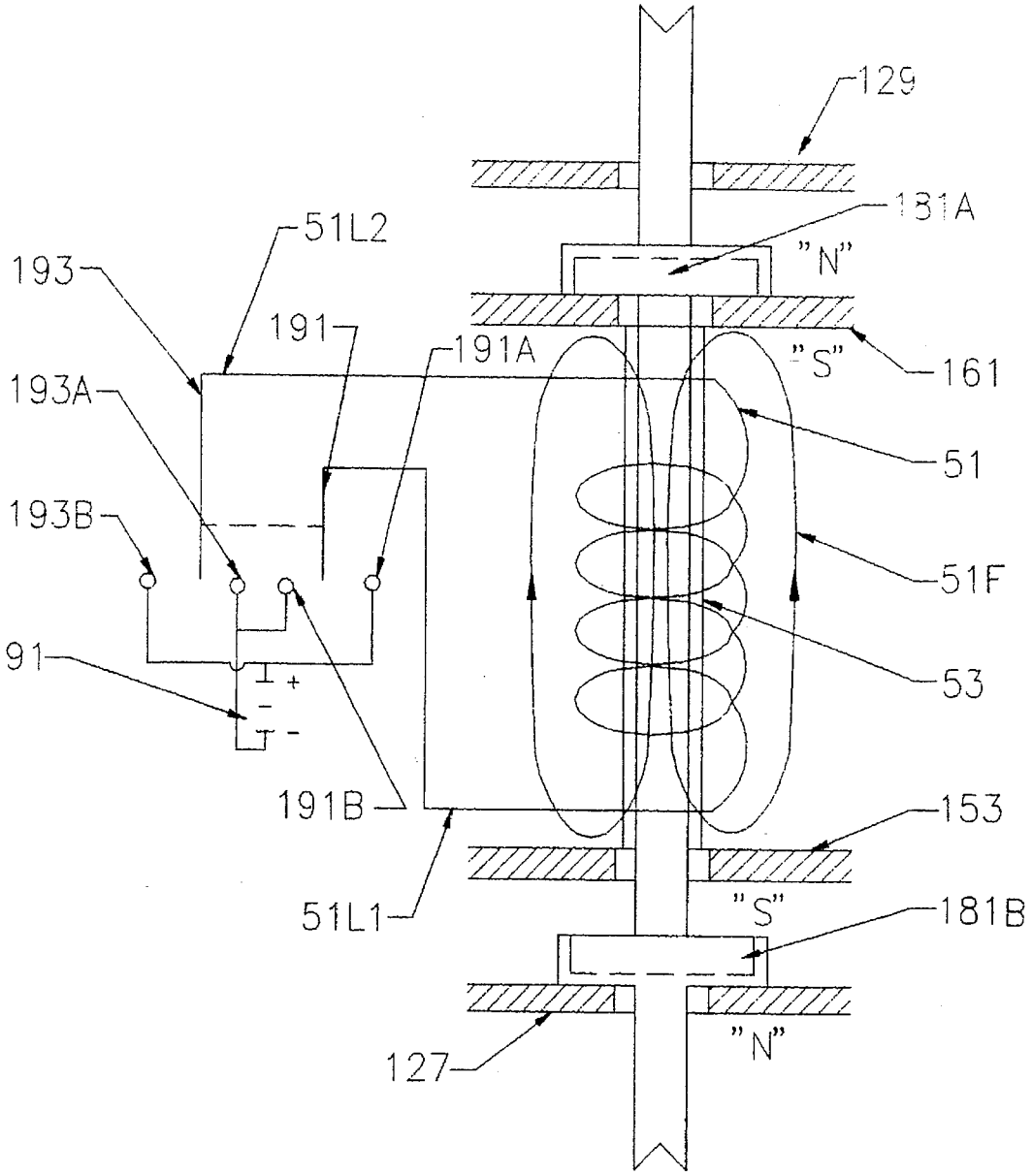
FIG. 8 schematically illustrates the solenoid of FIG. 6.

Referring now to FIGS. 6–8 the solenoid is identified by reference numeral 121. The solenoid 81 coil 51 and source 91 are the same as described with respect to the embodiment of FIG. 1–5. A hollow cylindrical housing 123 is provided having a hollow cylindrical wall 125 with an inward extending wall 127 at one end and a wall or cover 129 at the opposite end defining a cavity 131. Wall 127 is secured to wall 123 and has a central opening 134 formed therethrough. The cavity 131 has an opening 135 for receiving the coil 51 and its housing 141 and plunger 143 after which the cover 129 is secured to the end of the wall 125. The wall 129 has a central opening 145 formed therethrough. Preferably the housing 123 including walls 125, 127, and 129 is formed of a material such as a suitable stainless steel substantially unaffected by a magnetic field, although they could be formed of Corry 99.

The housing 141 comprises a hollow cylindrical wall 151 with an inward extending wall 153 at one other end. The wall 153 has a central opening 155 extending therethrough. The walls 151 and 153 form a cavity 157 with an opening 159 for receiving the coil 51. A cover 161 is provided with a central opening 163 extending therethrough for attachment to the end of the wall 151 after the coil 51 is inserted into the cavity 157. The walls 141, 153 and the cover 161 are not permanent magnets but are formed of a material of the type that can be magnetized when in a magnetic field. Members 141, 153, and 161 may be formed of steel such as Corry 99.

The housing 141 is fixedly secured in the cavity 131 to the inside of wall 125 with a suitable adhesive or by mechanical means. Openings 145, 163, 155, and 134 are in alignment. When the housing 141 is inserted in place, a space 171 is formed between walls 127 and 153 and a space 173 is formed between walls 129 and 161.

Before the inner housing 141 is inserted into the cavity 131 of the outer housing 125, a cylindrical plunger 143 is inserted through the coil opening 51 and through openings 155 and 163. The plunger 143 has an outer diameter less than the inside diameters of openings 133, 145, 155, and 161 such that the plunger 143 can freely move in opposite directions through these openings. Annular magnets 181A and 181B fixed in cavities of annular containers 183A and 183B are secured around the plunger 143 at positions such that the plunger 143 can move to a first position as shown in FIG. 6 wherein the face 181AF of the magnet 181A engages the wall 161 and the wall 183BW of the container 183B engages the wall 127 and to a second position wherein the face 181BF of the magnet 181B engages the wall 153 and the wall 183AW of the container 183A engages the wall 129. In the first and second positions of the plunger 143, the ends 143E1 and 183E2 of the plunger extend through openings 134 and 145 respectively. The plunger ends 143E1 and 143E2 have threaded openings 143T1 and 143T2 for attachment to extensions.

Figure 9:
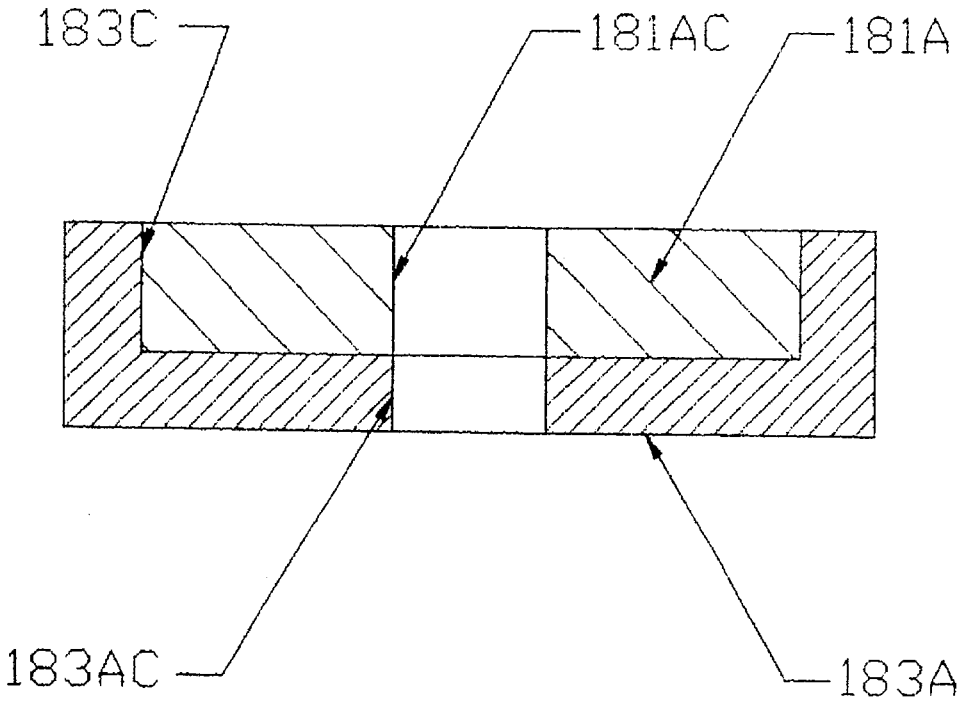
FIG. 9 is a cross-section of one of the permanent magnets and its housing of the embodiment of FIG. 6.

FIG. 9 illustrates the container 183A and the permanent magnet 181A. The magnet 181A has a central openings 181AC extending therethrough and the container 183A has an aligned central opening 183AC formed therethrough for receiving the plunger 143. The magnet 181A is secured in a cavity 183C of the container 183A. The magnet 181B and container 183B are identical to magnet 181A and container 183A respectively. The containers 183A and 183B and the plunger 143 are formed of a material such as stainless steel which is not substantially affected by a magnetic field.

The containers 183A and 183B are secured to the plunger 143 by suitable means to locate the magnets 181A and 181B at the desired positions and with the polarity of the magnets facing in directions such that when the plunger 143 is in its first position as shown in FIG. 6, the magnet 181A is attracted to the wall 161 to hold the plunger in this position (when the coil 51 is deactivated) and when the plunger 143 is in its second position, the magnet 181B is attracted to the wall 153 to hold the plunger in it second position (when the coil is deactivated).

When the coil 51 is activated by applying a current thereto in a first direction and the plunger is in its first position, the magnetic field 51F repels the magnet 181A from the wall 161 to move the plunger 143 to its second position which is held in the second position by the magnet 181B when the coil is deactivated. Ganged switches 191 and 193 are provided for energizing the coil 51. When the switches 191 and 193 contact terminals 191A and 193A, current is applied to the coil 51 from the source 91 in the first direction to move the plunger from its first position to its second position. When the switches 191 and 193 are moved to contact terminals 191B and 193B respectively, current in an opposition direction is applied to the coil 51 to repel the magnet 181B from the wall 153 to move the plunger to its first position where it is held in place by the magnet 181A when the coil 51 is deactivated.

The switches 191 and 193 may be electronic switches which may be controlled remotely.

Thus as can be understood, the solenoid of FIGS. 6–9 does not require springs and can be operated effectively in a very cold or very hot environment. The solenoid can be employed for control purposes.

Although the non-magnetic materials of the solenoids of the invention were described as formed of a suitable stainless steel, it is to be understood that other nonmagnetic materials may be used instead.

I claim:

1. A solenoid, comprising:

a housing comprising a surrounding wall forming an opening extending between first and second ends with first and second end walls coupled to said first and second ends of said surrounding wall respectively forming an enclosed cavity, an electrical coil fixedly located in said enclosed cavity of said housing, said electrical coil having a central opening extending therethrough with said central opening having a central axis, said electrical coil having first and second ends with said first end located near said first end of said surrounding wall of said housing, said second end wall of said housing being spaced from said second end of said coil, a rod formed of a material capable of being magnetized when located in a magnetic field, said rod being fixedly located in said central opening of said electrical coil and having an end extending to a position near said second end of said electrical coil, a plunger comprising a permanent magnet and support means for supporting said permanent magnet for movement in the space between said second end of said coil and said second end wall of said housing along a path in line with said central axis in opposite directions within said enclosed cavity to locate said permanent magnet in first and second positions wherein said end of said rod will be located in the magnetic field of said permanent magnet and in the magnetic field produced by said coil when energized such that when electrical power is applied to said coil, a magnetic field is produced by said coil which moves said plunger in a direction along said path to locate said permanent magnet in said second position spaced away from said second end of said coil and when the electrical power to said coil is terminated, the magnetic field produced by said permanent magnet moves said plunger along said path in a direction to locate said permanent magnet in said first position near said second end of said coil, said second end wall of said housing comprises an opening formed therethrough, said support means being moveably supported in said opening of said second end wall of said housing, said plunger comprises means for engaging said second end wall of said housing when said permanent magnet is moved to said second position for preventing movement of said permanent magnet beyond said second position, said plunger being the only movable means of said solenoid.

2. The solenoid of claim 1, wherein:

said magnetic field of said permanent magnet is the only force that moves said permanent magnet from said second position to said first position.

3. The solenoid of claim 1, wherein:

said opening of said surrounding wall is cylindrical in shape having a given diameter wherein the space between said second end of said coil and said second end wall is cylindrical in shape having a diameter substantially equal to that of said given diameter.

4. The solenoid of claim 1, wherein:

said support means extends through said opening of said second end wall with an end extending beyond said second end wall when said permanent magnet is located in said second position, said end of said support means when extending beyond said second end wall is unenclosed.

5. The solenoid of claim 1, comprising:

a source of electrical power, and a switch for connecting and disconnecting said source of electrical power to and from said electrical coil, said source of electrical power and said switch being located outside of said housing, said switch being the only means for connecting and disconnecting said source of electrical power to and from said coil.

6. The solenoid of claim 2, wherein:

said opening of said surrounding wall is cylindrical in shape having a given diameter wherein the space between said second end of said coil and said second end wall is cylindrical in shape having a diameter substantially equal to that of said given diameter.

7. The solenoid of claim 2, wherein:

said support means extends through said opening of said second end wall with an end extending beyond said second end wall when said permanent magnet is located in said second position, said end of said support means when extending beyond said second end wall is unenclosed.

8. The solenoid of claim 2, comprising:

a source of electrical power, and a switch for connecting and disconnecting said source of electrical power to and from said electrical coil, said source of electrical power and said switch being located outside of said housing, said switch being the only means for connecting and disconnecting said source of electrical power to and from said coil.

9. The solenoid of claim 6, wherein:

said support means extends through said opening of said second end wall with an end extending beyond said second end wall when said permanent magnet is located in said second position, said end of said support means when extending beyond said second end wall is unenclosed.

10. The solenoid of claim 6, comprising:

a source of electrical power, and a switch for connecting and disconnecting said source of electrical power to and from said electrical coil, said source of electrical power and said switch being located outside of said housing, said switch being the only means for connecting and disconnecting said source of electrical power to and from said coil.

11. The solenoid of claim 9, comprising:

a source of electrical power, and a switch for connecting and disconnecting said source of electrical power to and from said electrical coil, said source of electrical power and said switch being located outside of said housing, said switch being the only means for connecting and disconnecting said source of electrical power to and from said coil.

12. The solenoid of claim 3, wherein:

said support means extends through said opening of said second end wall with an end extending beyond said second end wall when said permanent magnet is located in said second position, said end of said support means when extending beyond said second end wall is unenclosed.

13. The solenoid of claim 3, comprising:

a source of electrical power, and a switch for connecting and disconnecting said source of electrical power to and from said electrical coil, said source of electrical power and said switch being located outside of said housing, said switch being the only means for connecting and disconnecting said source of electrical power to and from said coil.

14. The solenoid of claim 4, comprising:

a source of electrical power, and a switch for connecting and disconnecting said source of electrical power to and from said electrical coil, said source of electrical power and said switch being located outside of said housing, said switch being the only means for connecting and disconnecting said source of electrical power to and from said coil.

15. A solenoid, comprising:

a housing comprising a surrounding wall forming an opening extending between first and second ends with first and second end walls coupled to said first and second ends of said surrounding wall respectively forming an enclosed cavity, an electrical coil fixedly located in said enclosed cavity of said housing, said electrical coil having a central opening extending therethrough with said central opening having a central axis, said electrical coil having first and second ends with said first end located near said first end of said surrounding wall of said housing, said second end wall of said housing being spaced from said second end of said coil, a rod formed of a material capable of being magnetized when located in a magnetic field, said rod being fixedly located in said central opening of said electrical coil and having an end extending to a position near said second end of said electrical coil, a plunger comprising a permanent magnet and support means for supporting said permanent magnet for movement in the space between said second end of said coil and said second end wall of said housing along a path in line with said central axis in opposite directions within said enclosed cavity to locate said permanent magnet in first and second positions wherein said end of said rod will be located in the magnetic field of said permanent magnet and in the magnetic field produced by said coil when energized such that when electrical power is applied to said coil, a magnetic field is produced by said coil which moves said plunger in a direction along said path to locate said permanent magnet in said second position spaced away from said second end of said coil and when the electrical power to said coil is terminated, the magnetic field produced by said permanent magnet moves said plunger along said path in a direction to locate said permanent magnet in said first position near said second end of said coil, said second end wall of said housing comprises an opening formed therethrough, said support means being moveably supported in said opening of said second end wall of said housing, said plunger comprises means for engaging said second end wall of said housing when said permanent magnet is moved to said second position for preventing movement of said permanent magnet beyond said second position, a source of electrical power, and a switch for connecting and disconnecting said source of electrical power to and from said electrical coil, said source of electrical power and said switch being located outside of said housing, said switch being the only means for connecting and disconnecting said source of electrical power to and from said coil.

16. The solenoid of claim 15, wherein:

said opening of said surrounding wall is cylindrical in shape having a given diameter wherein the space between said second end of said coil and said second end wall is cylindrical in shape having a diameter substantially equal to that of said given diameter.

17. The solenoid of claim 15, wherein:

said support means extends through said opening of said second end wall with an end extending beyond said second end wall when said permanent magnet is located in said second position, said end of said support means when extending beyond said second end wall is unenclosed.

18. The solenoid of claim 16, wherein:

said support means extends through said opening of said second end wall and with an end extending beyond said second end wall when said permanent magnet is located in said second position, said end of said support means when extending beyond said second end wall is unenclosed.

19. A solenoid, comprising:

a housing comprising a cylindrical wall having a cylindrical opening extending between first and second ends with first and second end walls coupled to said first and second ends of said cylindrical wall respectively forming an enclosed cavity, an electrical coil fixedly located in said enclosed cavity of said housing, said electrical coil having a central opening extending therethrough with said central opening having a central axis, said electrical coil having first and second ends, said second end wall of said housing being spaced from said second end of said coil, a rod formed of a material capable of being magnetized when located in a magnetic field, said rod being fixedly located in said central opening of said electrical coil and having an end extending to a position near said second end of said electrical coil, a plunger comprising a permanent magnet and support means for supporting said permanent magnet for movement in the space between said second end of said coil and said second end wall of said housing along a path in line with said central axis in opposite directions within said enclosed cavity to locate said permanent magnet in first and second positions such that when electrical power is applied to said coil, a magnetic field is produced by said coil which moves said plunger in a direction along said path to locate said permanent magnet in said second position spaced away from said second end of said coil and when the electrical power to said coil is terminated, the magnetic field produced by said permanent magnet moves said plunger along said path in a direction to locate said permanent magnet in said first position near said second end of said coil, said second end wall of said hosing comprises an opening formed therethrough, said support means being moveably supported in said opening of said second end wall of said housing, said plunger comprises means for engaging said second end wall of said housing when said permanent magnet is moved to said second position for preventing movement of said permanent magnet beyond said second position, said plunger being the only movable means in said cavity of said housing of said solenoid.

* * * * *